US009631884B2

(12) United States Patent
Kim

(10) Patent No.: US 9,631,884 B2
(45) **Date of Patent: *Apr. 25, 2017**

(54) APPARATUS FOR STORING AND LOADING MULTIPLE ROWS OF AMMUNITION

(71) Applicant: Raymond Kyungjune Kim, Federal Way, WA (US)

(72) Inventor: Raymond Kyungjune Kim, Federal Way, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/922,167

(22) Filed: Oct. 25, 2015

(65) Prior Publication Data

US 2017/0030670 A1 Feb. 2, 2017

Related U.S. Application Data

(63) Continuation-in-part of application No. 14/816,020, filed on Aug. 2, 2015.

(51) Int. Cl.
*F41A 9/84* (2006.01)
*F41A 9/83* (2006.01)

(52) U.S. Cl.
CPC . *F41A 9/83* (2013.01); *F41A 9/84* (2013.01)

(58) Field of Classification Search
CPC ..... F41A 9/83; F41A 9/84
USPC ..... 42/87, 88
See application file for complete search history.

(56) References Cited

U.S. PATENT DOCUMENTS 1,786,537 A * 12/1930 Holek ..... F41A 9/83 42/87
2,451,521 A * 10/1948 Uglum ..... F41A 9/83 244/155 A
4,739,572 A * 4/1988 Brandenburg ..... F41A 9/83 42/87
8,931,199 B1 * 1/2015 Cauley, Jr. ..... F41A 9/83 42/87

* cited by examiner

*Primary Examiner* — Stephen M Johnson
(74) *Attorney, Agent, or Firm* — Dascenzo Intellectual Property Law, P.C.; Ian D. Gates

(57) ABSTRACT

The invention provides an ammunition storage box that stores and loads multiple successive rows of ammunition cartridges into firearms magazines. The box includes an interior channel and multiple openings that lead into the channel. The channel is configured to host and dispense cartridges into a firearms magazine interfaced with the box via a proximal opening, which leads into the channel. The box also includes cartridge slots, recessed into the box and convergent with the channel, that comprise recessed chambers configured to host cartridges. The box also includes a rod, configured to slideably engage within the channel and displace cartridges within the channel out from the channel. The rod is also configured to encapsulate the cartridge slots when expanded into the chamber.

24 Claims, 16 Drawing Sheets

APPARATUS FOR STORING AND LOADING MULTIPLE ROWS OF AMMUNITION

RELATED APPLICATION

This application is a continuation-in-part of and claims priority to U.S. patent application Ser. No. 14/816,020, filed on Aug. 2, 2015 and entitled "Apparatus for Storing and Loading Multiple Rows of Ammunition," the complete disclosure of which is incorporated herein by reference.

BACKGROUND OF THE INVENTION

1. Field of the Invention

The present invention relates to ammunition cartridge storing and loading tools for firearms magazines.

2. Description of the Prior Art

Many contemporary ammunition box designs that are configured to sterily store and also load ammunition cartridges into firearms magazines do not have the ability to store and load more than one row of cartridges. Designs that do allow for the storage and loading of multiple rows of cartridges often require a large number of moving components to facilitate the alignment and urging of successive rows of cartridges into a magazine. Unfortunately, history has revealed time and time again that apparatuses with a large number of moving parts often have reduced reliability in outdoor environments.

At the moment, there exists no prior art design of ammunition storage and loading apparatuses that can align successive rows of ammunition cartridges for urging into a magazine without the utilization of a large number of moving components.

SUMMARY OF THE INVENTION

In light of the limitations of existing ammunition storage and loading apparatuses, it is the object of the present invention to provide an apparatus that can store multiple rows of ammunition cartridges and successively align each row of stored cartridges for urging into a firearms magazine using a significantly reduced number of moving components.

According to an embodiment of the present invention, an apparatus for storing and loading multiple rows of ammunition cartridges comprises an elongated rectangular box having a proximal long end, a distal long end and an adjacent side that lies between the proximal and distal long ends. The rectangular box comprises a linear channel that runs within the rectangular box, initiating at the proximal long end and running to the distal long end. The proximal long end, distal long end and adjacent side comprise a cartridge dispensing opening, rod entry opening and cartridge entry opening, respectively, all of which lead into the linear channel.

The rectangular box comprises cartridge slots that are recessed into the rectangular box through topside openings on the adjacent side. These cartridge slots are convergent with the linear channel and are configured to receive and host ammunition cartridges via the topside openings. Each cartridge slot extends a partition wall, which segregates the extending cartridge slot from an adjacent cartridge slot. In one embodiment, each cartridge slot extends a partition wall from a portion of the cartridge slot that lies of farthest distance from the dispensing opening. In one embodiment, partition walls are angled in such a manner as to guide cartridges hosted within cartridge slots into the linear channel. In one embodiment, the cartridge slots are arranged in two independent single file rows whose lengths run parallel with that of the linear channel. In this same embodiment, these two independent rows of cartridge slots are tangent with the linear channel on two opposing sides of the linear channel. Also in this same embodiment, partition walls on both rows of cartridge slots are offset from linear alignment with one another. In one embodiment, partition walls on one row of cartridge slots are offset from lateral alignment with partition walls of the opposing row of cartridge slots. Cartridge slots are recessed into the rectangular box in such a manner as to leave a height of space, within the linear channel, between the bottom of the cartridge slot recesses, defined as slot floors, and a linear channel interior wall that lies farthest from the adjacent side, defined as the channel floor. Each slot floor defines a slope located on the common edge shared by each slot floor and the height of space within the linear channel. The cartridge slots comprise obstruction walls that are tangent with the linear channel and run from each cartridge slot's partition wall towards the dispensing opening until within a gap of distance from an adjacent cartridge slot's partition wall. In one embodiment, the size of this gap of distance is equal to the width of an ammunition cartridge. Each gap of distance defines a slot side opening, configured to facilitate the passage of cartridges from the cartridge slots into the linear channel. The cartridge slots define depressed chambers that are recessed into each cartridge slot floor and are configured to host ammunition cartridges. In one embodiment, depressed chambers are tangent with obstruction walls while non-tangent with cartridge slot side openings.

According to an embodiment of the present invention, the apparatus is loaded with ammunition cartridges via the positioning of ammunition cartridges into the depressed chambers through the topside openings and the cartridge slots. In one embodiment, cartridges are inserted through the topside openings with the base primer sides of cartridges facing foremost towards the depressed chambers.

According to an embodiment of the present invention, an apparatus for storing and loading multiple rows of ammunition cartridges comprises an urging rod. The urging rod is shaped as an elongated rectangular block and extends a planar shaped flat cover that is coupled to the elongated rectangular block in such a manner as to form a T shape. The urging rod is slideably engaged within the rectangular box linear channel, through the rod entry opening, in such a manner as to cause the flat cover to slideably engage with the rectangular box adjacent side.

The apparatus of the present invention is configured for the sterile storage of cartridges via urging of the urging rod into the linear channel, through the rod entry opening, towards the dispensing opening until the urging rod comes into tangency with the dispensing opening. This action causes the urging rod to obstruct slot side openings, preventing cartridges hosted within cartridge slots and depressed chambers, with obstructed slot side openings, from moving into the linear channel. Simultaneously, as the urging rod is slideably engaged within the linear channel and shifted toward tangency with the dispensing opening, the flat cover is slideably engaged with the adjacent side and shifted to successively encapsulate all of the topside openings leading into the cartridge slots and depressed chambers.

In another preferred embodiment, the apparatus of the present invention is interfaced with a firearms magazine for the transfer of cartridges from the apparatus into a firearms magazine. In one embodiment, this is accomplished by coupling a feed opening of a firearms magazine with the apparatus dispensing opening in such a manner that the magazine feed opening is oriented, relative to the dispensing opening, to receive cartridges from the dispensing opening in the same angular orientation by which the firearms magazine properly feeds ammunition cartridges into a firearm.

In a preferred embodiment, the apparatus of the present invention is configured to displace cartridges from each depressed chamber into a corresponding cartridge slot with the canting of the apparatus and interfaced magazine to such an angular orientation that the linear channel floor is elevated over the adjacent side while the rod entry opening is elevated over the cartridge dispensing opening. This canting causes cartridges hosted in each depressed chamber to move toward the top side openings, by force of gravity, until obstructed from further directional movement by the flat cover. Simultaneous to being obstructed by the flat cover, the cartridges are fully displaced from their respective depressed chambers and influenced toward partition walls adjacent to their respective depressed chambers, by means of gravity. The displaced cartridges move toward their adjacent partition walls until obstructed from further directional movement by their respective adjacent partition walls. The apparatus and interfaced magazine are then canted to such an orientation as to cause the adjacent side to be elevated over the linear channel floor while the rod entry opening is elevated over the cartridge dispensing opening. This causes the cartridges obstructed by the partition walls to move into tangency with the slot floors, by means of gravity.

In a preferred embodiment, the apparatus of the present invention is configured to dispense cartridges into the interfaced magazine with the retraction of the urging rod from the linear channel through the rod entry opening. The urging rod, successively removed from tangency with each of the slot side openings, clears a path for cartridges hosted within the cartridge slots to shift out from their respective cartridge slots, through their corresponding slot side openings, toward the linear channel. In one embodiment, cartridges are shifted out from their respective cartridge slots via the assistance of the angled partition walls, the slot floor defined slopes and the force of gravity. The cartridges continue to move toward the linear channel until obstructed from further directional movement by the obstruction walls of the opposing row of the cartridge slots, at which point the cartridges move into the non-convergent height of space within the linear channel, by means of gravity. Simultaneously, each cartridge also moves towards the dispensing opening, aided by gravity, until coming into tangency with the interfaced magazine or a cartridge that is stacked in succession leading into the magazine. The urging rod is then urged towards the dispensing opening, causing cartridges positioned within the non-convergent height of space, within the linear channel, to shift through the dispensing opening and into the feed opening of the interfaced firearms magazine.

BRIEF DESCRIPTION OF DRAWINGS

The preferred embodiment of the present invention is described in detail below with reference to the following drawings.

DETAILED DESCRIPTION OF THE PREFERRED EMBODIMENT

Figure 1A:
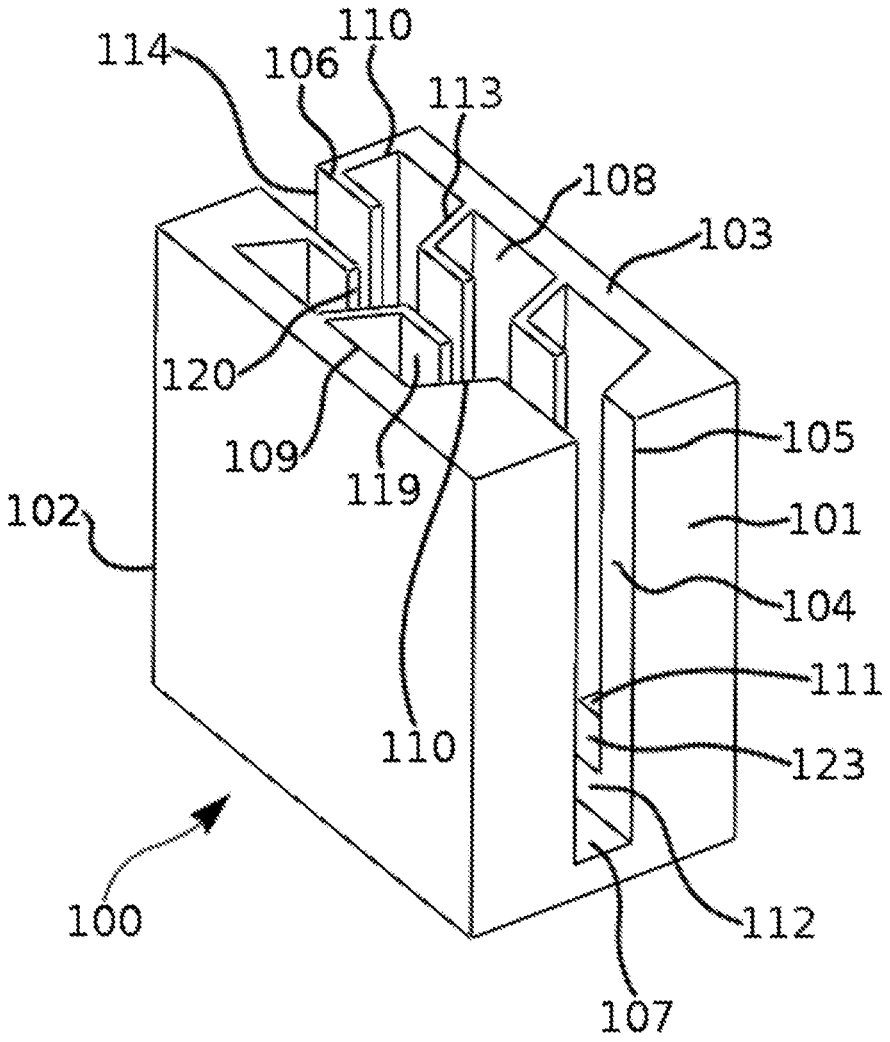
FIG. 1A is an angle side view of the preferred embodiment elongated rectangular box.
Figure 1B:
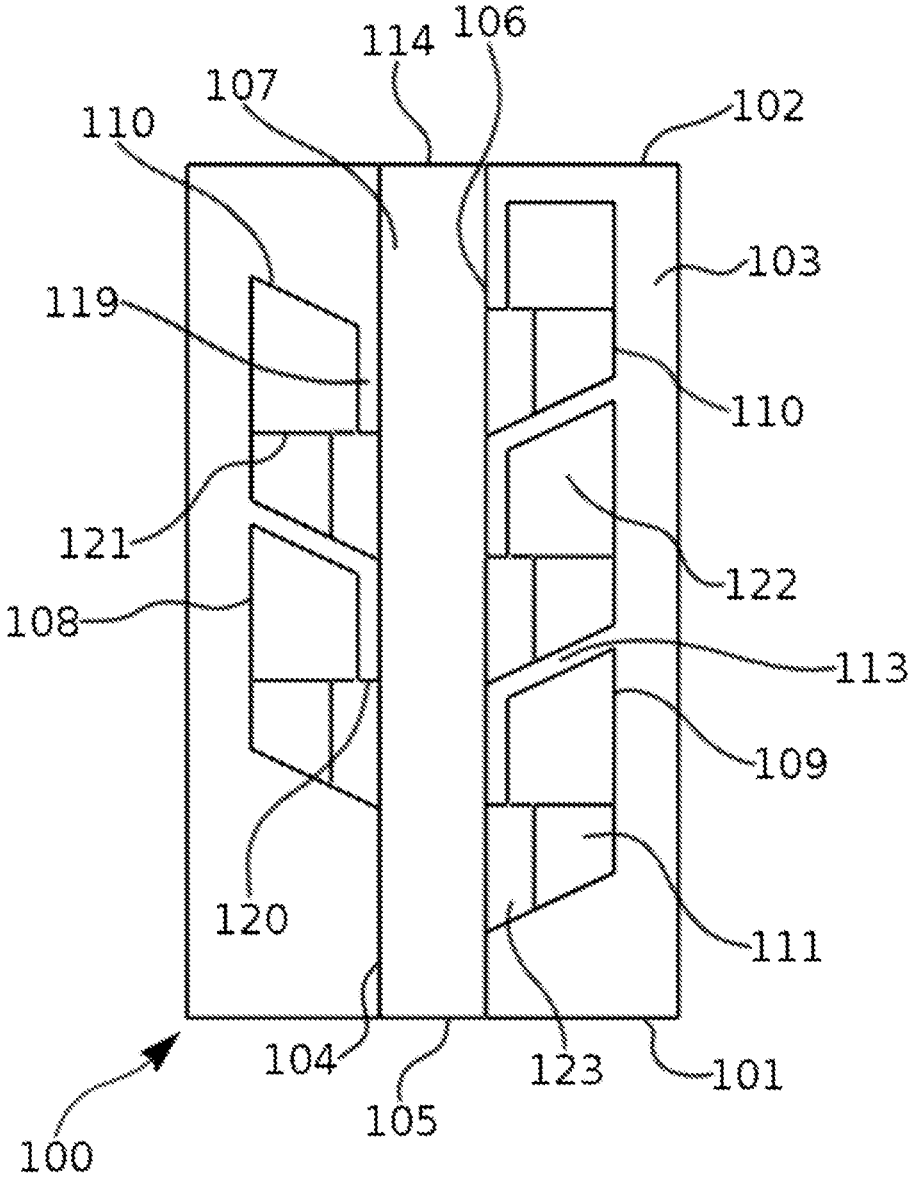
FIG. 1B is a top down view of the preferred embodiment elongated rectangular box.
Figure 1C:
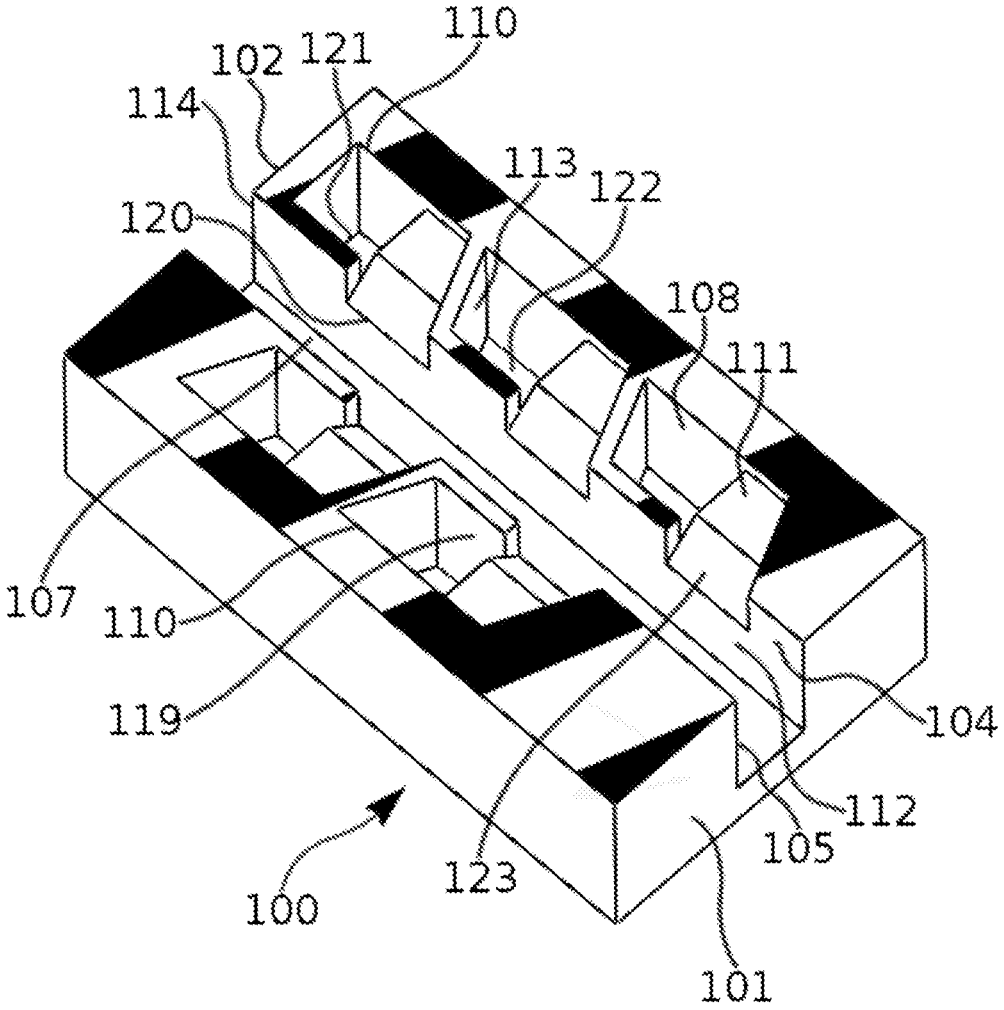
FIG. 1C is an angle side view cross-section of the preferred embodiment elongated rectangular box.
Figure 1D:
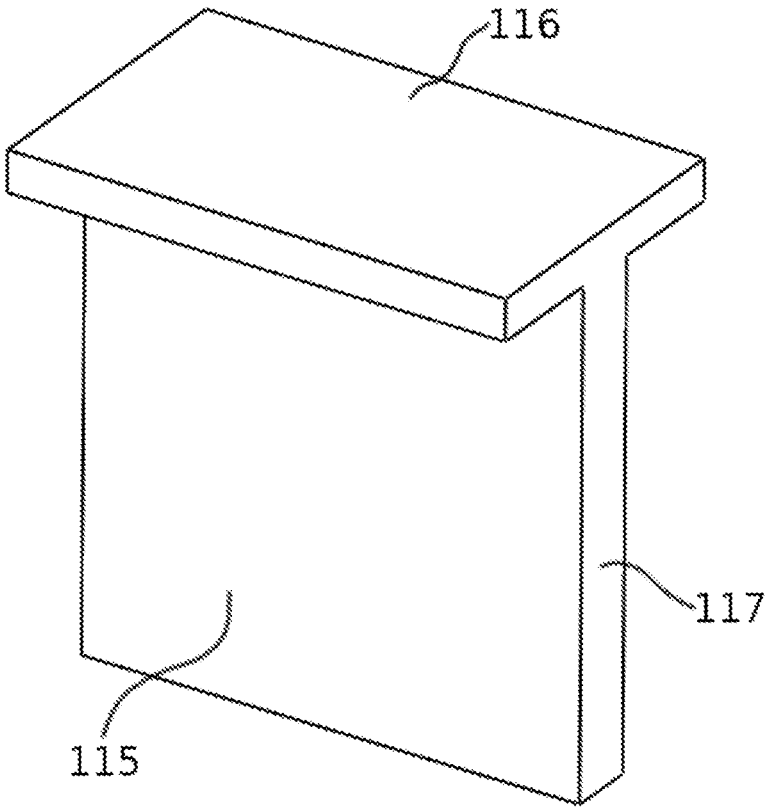
FIG. 1D is an angled side view of the preferred embodiment cartridge urging rod.
Figure 1E:
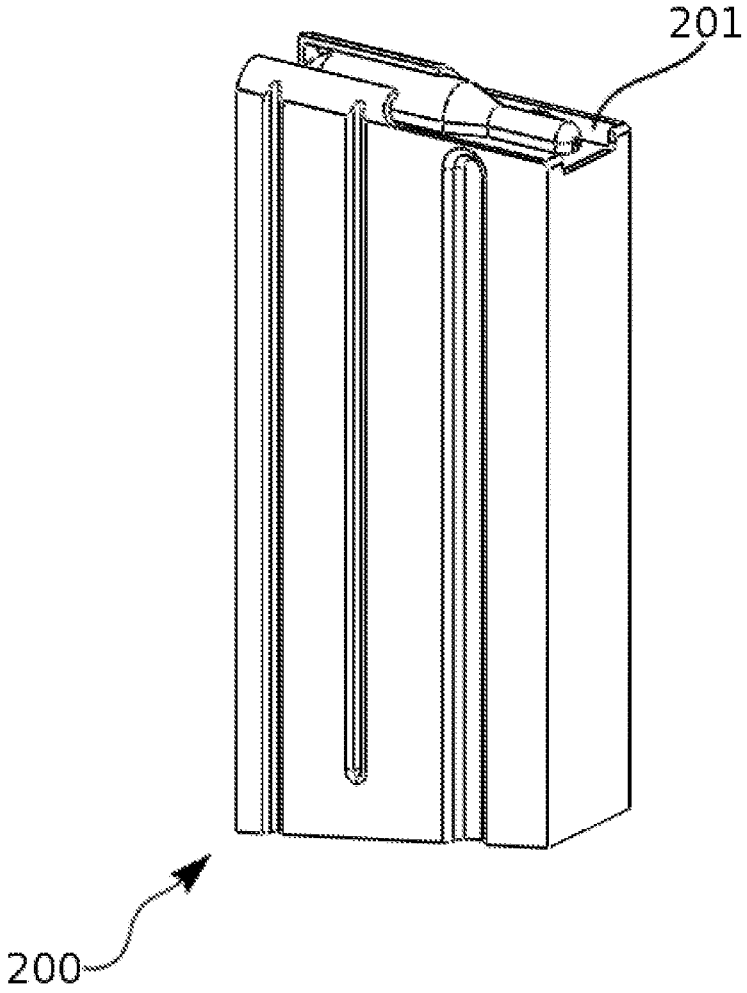
FIG. 1E is an angled side view of a firearms magazine.
Figure 1F:
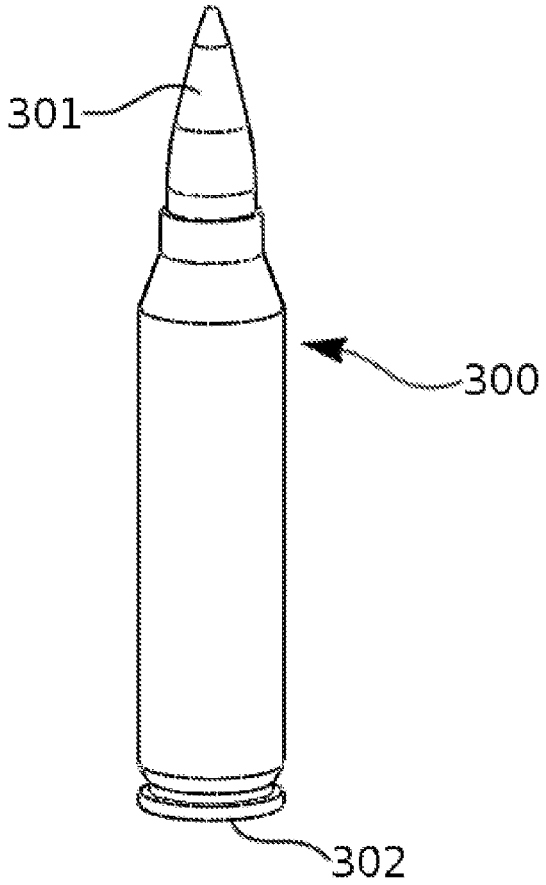
FIG. 1F is a frontal view of an ammunition cartridge.

In reference to FIGS. 1A, 1B, 1C, 1D, 1E, and 1F an apparatus for storing and loading multiple rows of ammunition cartridges, in its preferred embodiment, comprises an elongated rectangular box 100. The rectangular box 100 comprises a proximal long end 101 and a distal long end 102 on opposite long ends of the rectangular box 100. The rectangular box further comprises an adjacent side 103, which occupies a facet of the rectangular box 100 that lies between the proximal long end 101 and distal long end 102. The rectangular box 100 further comprises a rectangular linear channel 104 that runs within the rectangular box 100, starting at the proximal long end 101 and terminating at the distal long end 102. The linear channel 104 is configured to receive and host ammunition cartridges 300. In one embodiment, the linear channel 104 hosts cartridges 300 in a single file configuration.

The proximal long end 101 defines a cartridge dispensing opening 105 that opens into the linear channel 104 and is configured to engage with a feed opening 201 of a firearms magazine 200. When engaged with the feed opening 201 of a firearms magazine 200, the dispensing opening 105 facilitates the passage of ammunition cartridges 300, hosted within the linear channel 104, from the linear channel 104 into the feed opening 201.

The adjacent side 103 of the rectangular box 100 defines a cartridge entry opening 106 that opens into the linear channel 104. The linear channel 104 defines a channel floor 107 that occupies a wall of the linear channel 104 that lies farthest from the cartridge entry opening 106.

In one embodiment, the linear channel 104 is shaped in such a manner that cartridges 300 received into the linear channel 104 are arranged into a single file whose length is parallel with that of the linear channel 104. In one embodiment, cartridges 300 received and hosted within the linear channel 104 are oriented in such a manner that their bullet tips 301 point toward the cartridge entry opening 106 from within the linear channel 104 while their base primer sides 302 are tangent with the channel floor 107.

The adjacent side 103 further defines multiple cartridge slots 108 that are individually recessed into the rectangular box 100 through the adjacent side 103. Each cartridge slot 108 comprises a topside opening 109 that leads into each cartridge slot 108 from the adjacent side 103. Each cartridge slot 108 is configured to host ammunition cartridges 300 and each topside opening 109 is configured to facilitate the positioning of cartridges 300 into its respective cartridge slot 108. In one embodiment, cartridge slots 108 are recessed into the rectangular box 100 at a depth equal to the height of an ammunition cartridge 300. Each cartridge slot 108 is convergent with the linear channel 104 and configured to displace cartridges 300 into the linear channel 104. In one embodiment, each cartridge slot 108 is sized to host one cartridge 300. In one embodiment, each cartridge slot 108 is sized to host two cartridges 300.

The cartridge slots 108 define slot floors 111, which are portions of the cartridge slots 108 that are furthest recessed into the rectangular box 100. In one embodiment, the cartridge slots 108 host cartridges 300 with the base primer sides 302 of cartridges 300 tangent with the slot floors 111. In one embodiment, the cartridge slots 108 host cartridges 300 with the bullet tips 301 of cartridges 300 tangent with the slot floors 111. The linear channel 104 defines a non-convergent height of space 112 within the linear channel 104 that lays between the slot floors 111 and the channel floor 107 and is non-convergent with the cartridge slots 108. This non-convergent height of space 112 is sized to maintain cartridges 300 positioned within the linear channel 104 in a single file configuration. The height of space 112 in conjunction with the slot floors 111 define slopes 123 on edges of the slot floors 111 that are tangent with the height of space 112. These slopes 123 are configured to guide cartridges 300 hosted within cartridge slots 108 into the linear channel 104 and into tangency with the height of space 112.

Each cartridge slot 108 extends a partition wall 113 that separates each cartridge slot 108 from an adjacent cartridge slot 108. In one embodiment, each cartridge slot 108 extends a partition wall 113 from a portion of the cartridge slot 108 that lies of farthest distance away from the dispensing opening 105. In one embodiment, the length of each partition wall 113 runs perpendicular to the length of the linear channel 104. In one embodiment, each partition wall 113 runs angled to the length of the linear channel 104 in such a manner as to guide cartridges 300 hosted within each cartridge slot 108 toward the linear channel 104. In one embodiment, the cartridge slots 108 are arranged in two independent single file rows 110 whose lengths run parallel with that of the linear channel 104. In this same embodiment, these two independent rows 110 of cartridge slots 108 are tangent with the linear channel 104 on two opposing sides of the linear channel 104. Also in this same embodiment, the partition walls 113 on one row 110 of cartridge slots 108 are offset from linear alignment with the partition walls 113 of the opposing row 110 of cartridge slots 108. In one embodiment, partition walls 113 on one row of cartridge slots 110 are offset from lateral alignment with partition walls 113 on the opposing row of cartridge slots 110 by half the length of a cartridge slot.

Each cartridge slot 108 comprises an obstruction wall 119, whose length runs parallel with that of linear channel 104. Each obstruction wall 119 is tangent with the linear channel 104 and configured to obstruct cartridges 300 displaced from an opposing row 110 of cartridge slots 108 from entering the cartridge slot 108 that comprises it. In one embodiment, each obstruction wall 119 is perpendicularly extended from a partition wall 113 and runs in the direction of the dispensing opening 105 until within a gap of distance from the partition wall 113 of an adjacent cartridge slot 108. In one embodiment, this gap of distance is equal to the width of one ammunition cartridge 300. The gaps of distance between each obstruction wall 119 and adjacent cartridge slot partition wall 113 each define a cartridge slot side opening 120 that is configured to facilitate the passage of cartridges 300 from each cartridge slot 108 into the linear channel 104.

Each cartridge slot 108 defines a depressed chamber 121 that is recessed into each cartridge slot's 108 slot floor 111 and is configured to host cartridges 300. In one embodiment, depressed chambers 121 are tangent with obstruction walls 119 while non-tangent with cartridge slot side openings 120. In one embodiment, each depressed chamber 121 hosts a single ammunition cartridge 300. In one embodiment, each depressed chamber 121 hosts multiple ammunition cartridges 300. Each depressed chamber 121 defines a chamber floor 122, which is the most recessed facet of each depressed chamber 121. In one embodiment, depressed chambers 121 are recessed into slot floors 111 to such an extent that each depressed chamber's 121 chamber floor 122 lies flush with the linear channel floor 107. In one embodiment, chamber floors 122 host cartridges 300 with the base primer sides 302 of cartridges 300 tangent with the chamber floors 122. In one embodiment, chamber floors 122 host cartridges 300 with the bullet tips 301 of cartridges 300 tangent with the chamber floors 122.

The distal long end 102 of the rectangular box 100 defines a rod entry opening 114 that opens into the linear channel 104 and is configured to facilitate the entry of a cartridge urging rod 115 into the linear channel 104.

The apparatus for storing and loading multiple rows of ammunition, in its preferred embodiment, comprises an urging rod 115 that is shaped as an elongated rectangular block with two short sides and four long sides. The urging rod 115 is configured to slideably engage within the linear channel 104, through the rod entry opening 114, with two opposing long sides of the urging rod 115 slideably engaged with the non-convergent height of space 112 and one long side slideably engaged with the channel floor 107. The urging rod 115 comprises a planar shaped flat cover 116 that extends from the one long side of the urging rod 115 that does not slideably engage with the non-convergent height of space 112 or the channel floor 107 when the urging rod 115 is engaged within the linear channel 104. The flat cover 116 extends from the urging rod 115 in such a manner as to form a T shape with the urging rod 115. The flat cover 116 runs the length of the urging rod 115 and is sized to encapsulate the rectangular box adjacent side 103. The urging rod 115 further comprises a pressing surface 117 on a short side of the urging rod 115 that faces foremost towards the dispensing opening 105 when the urging rod 115 is slideably engaged within the linear channel 104 through the rod entry opening 114. The pressing surface 117 is configured to urge ammunition cartridges 300 and objects hosted within the linear channel 104 out from the linear channel 104 through the dispensing opening 105. The length of the urging rod 115 is sized so as to cause the urging rod 115 to fully encapsulate the linear channel 104 when the urging rod 115 is slideably engaged within the linear channel 104 and the pressing surface 117 is tangent with the dispensing opening 105. When the urging rod 115 is engaged with linear channel 104 in such a manner that it fully encapsulates the linear channel 104, the urging rod 115 obstructs objects from entering into the linear channel 104 via the dispensing opening 105, cartridge entry opening 106, the slot side openings 120 and the rod entry opening 114. Simultaneously, when the urging rod 115 is engaged to fully encapsulate the linear channel 104, the flat cover 116 encapsulates the adjacent side 103 and obstructs the passage of cartridges 300 and objects into and out from the cartridge slots 108 via the topside openings 109.

Figure 2A:
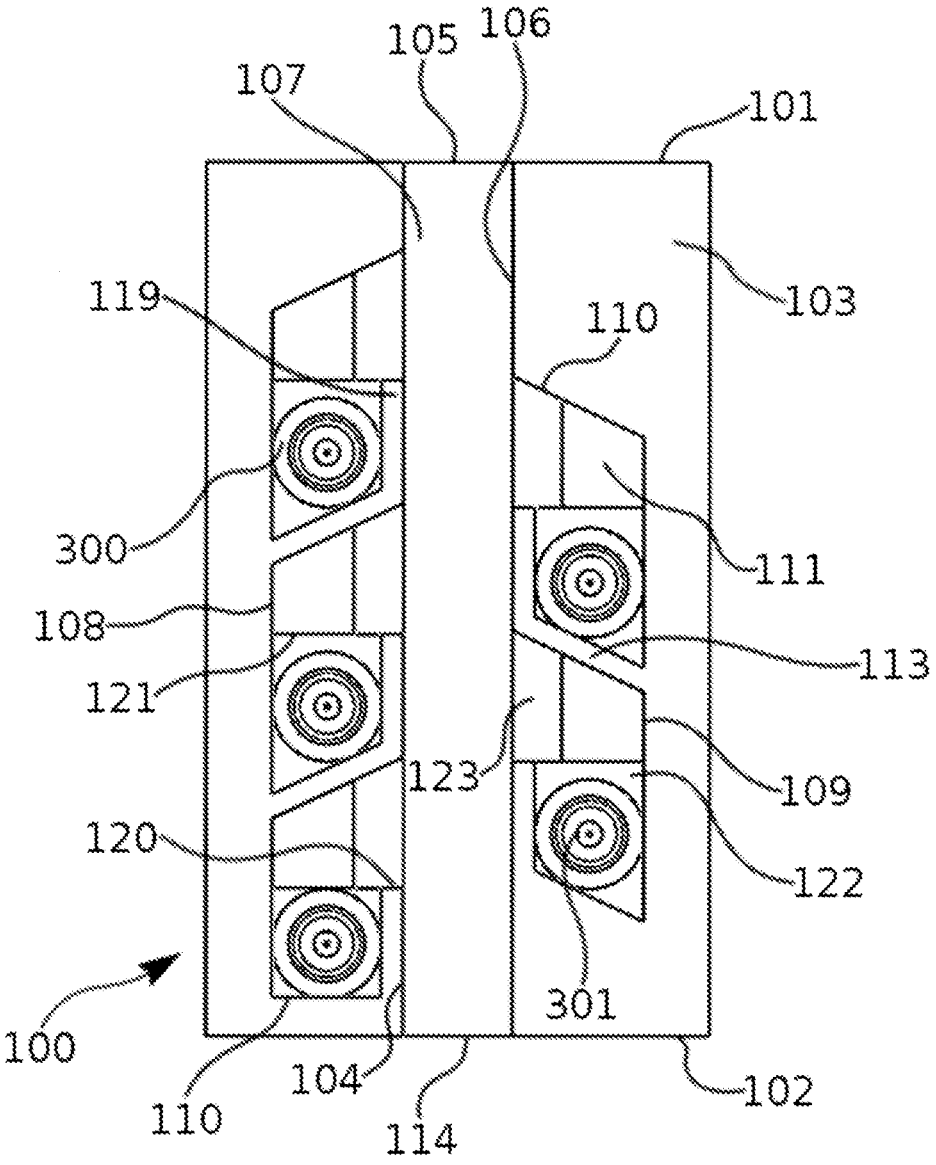
FIG. 2A is a frontal view of the preferred embodiment elongated rectangular box, canted upside down and configured with ammunition cartridges.
Figure 2B:
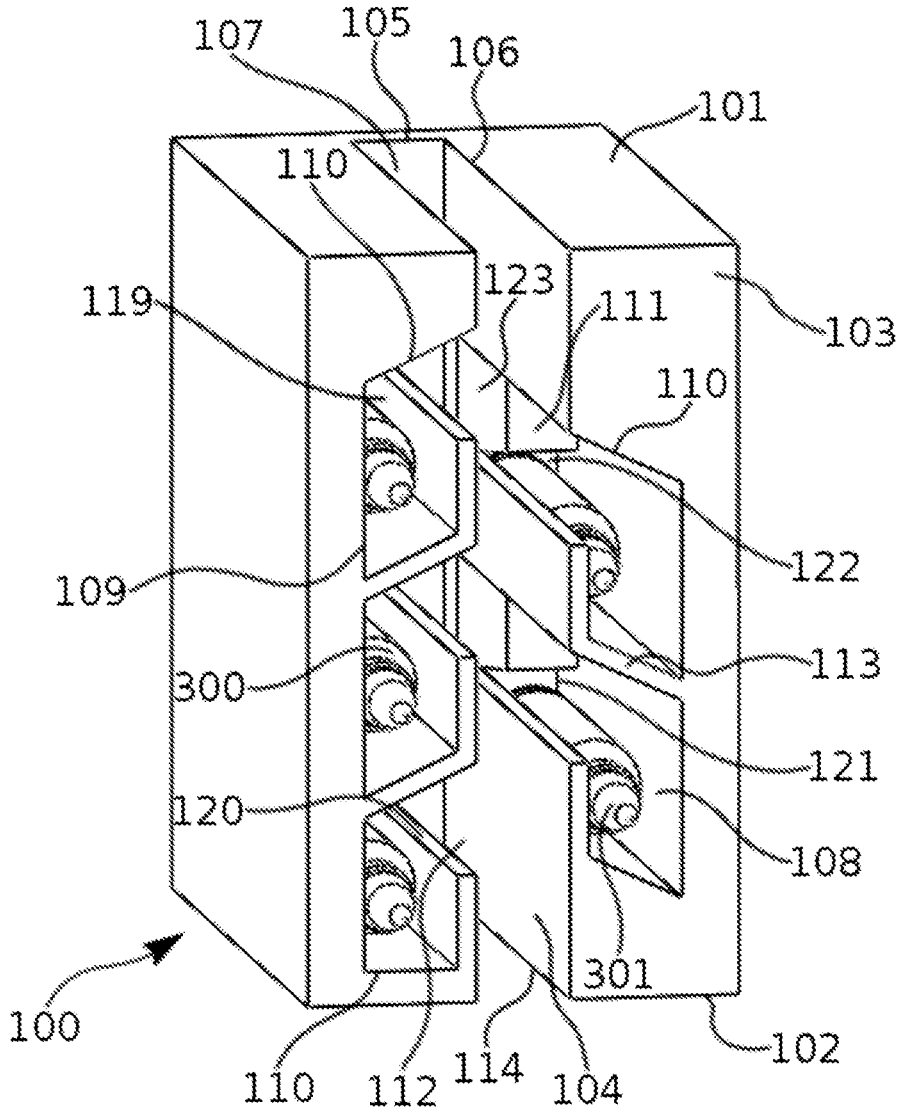
FIG. 2B is an angled side view of the preferred embodiment elongated rectangular box, canted upside down and configured with ammunition cartridges.

In reference to FIGS. 2A and 2B, the apparatus for storing and loading multiple rows of ammunition cartridges is configured to receive ammunition cartridges 300 into the depressed chambers 121 with the canting of the apparatus in such a manner that the cartridge dispensing opening 106 is elevated over the rod entry opening 114 and the adjacent side 103 is elevated over the linear channel floor 107.

Ammunition cartridges 300 are positioned into the depressed chambers 121 through the adjacent side topside openings 109 and the cartridge slots 108. In one embodiment, cartridges 300 are inserted through the topside openings 109 with the base primer sides 302 of cartridges 300 facing foremost towards the chamber floors 122. In one embodiment, cartridges 300 are inserted through the topside openings 109 with the bullet tips 301 of cartridges 300 facing foremost towards the chamber floors 122.

Figure 3:
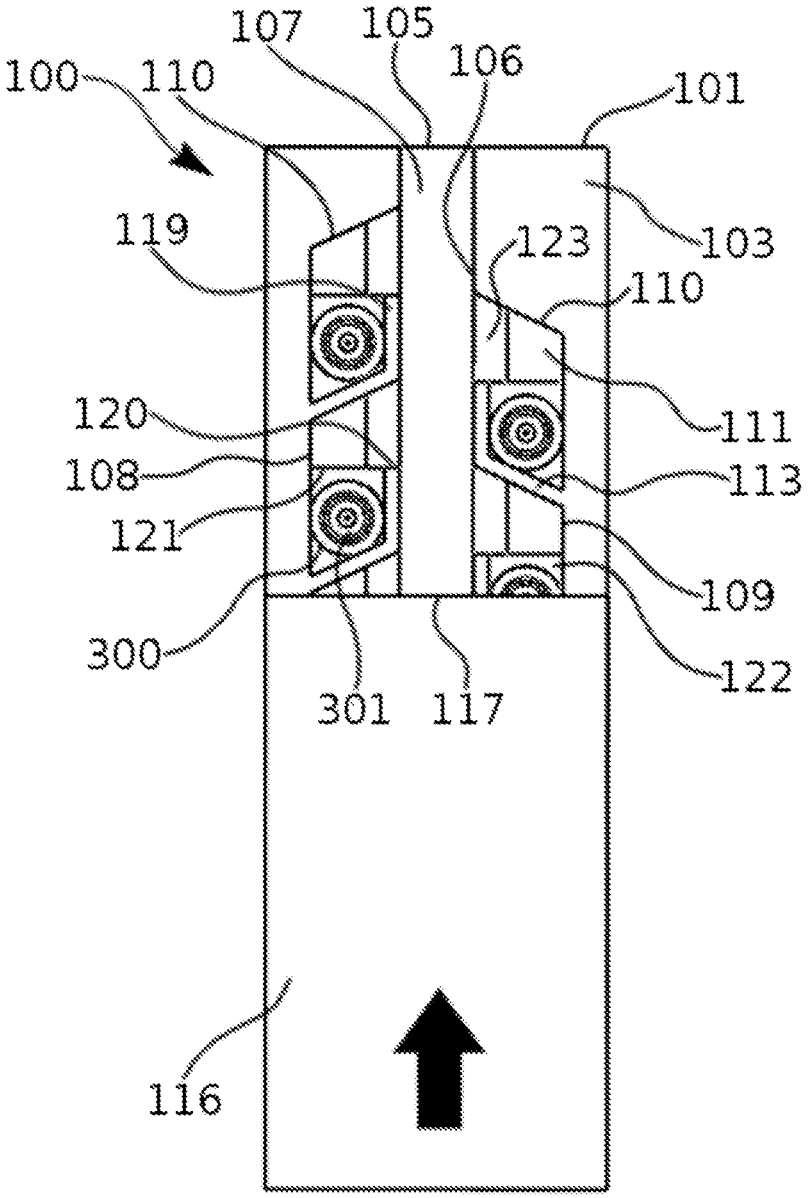
FIG. 3 is a frontal view of the preferred embodiment cartridge urging rod, slideably engaged within the elongated rectangular box.

In reference to FIG. 3, the apparatus for storing and loading multiple rows of ammunition cartridges is configured to sterily store ammunition cartridges 300 with the engagement of the urging rod 115 into the linear channel 104 via the rod entry opening 114. The urging rod 115 is engaged within the linear channel 104 in such a manner that the pressing surface 117 is placed foremost through the rod entry opening 114 while the flat cover 116 slideably engages with the rectangular box adjacent side 103. Within the linear channel 104, the pressing surface 117, and thus the urging rod 115, is urged through the rod entry opening 114 towards the dispensing opening 105. While moving toward the dispensing opening 105, the urging rod 115 and flat cover 116 come into tangency with successive slot side openings 120 and topside openings 109, respectively. These successive slot side openings 120 and topside openings 109 are subsequently encapsulated by the urging rod 115 and flat cover 116, respectively, preventing cartridges 300 hosted within each successively encapsulated cartridge slots 108 and depressed chambers 121 from moving out from their respective cartridge slots 108 and respective adjacent cartridge slots 108, respectively. The pressing surface 117 is eventually brought into tangency with the dispensing opening 105, causing the urging rod 115 to encapsulate all slot side openings 120 and the flat cover 116 to fully encapsulate the adjacent side 103, and thus all of the topside openings 109.

Figure 4:
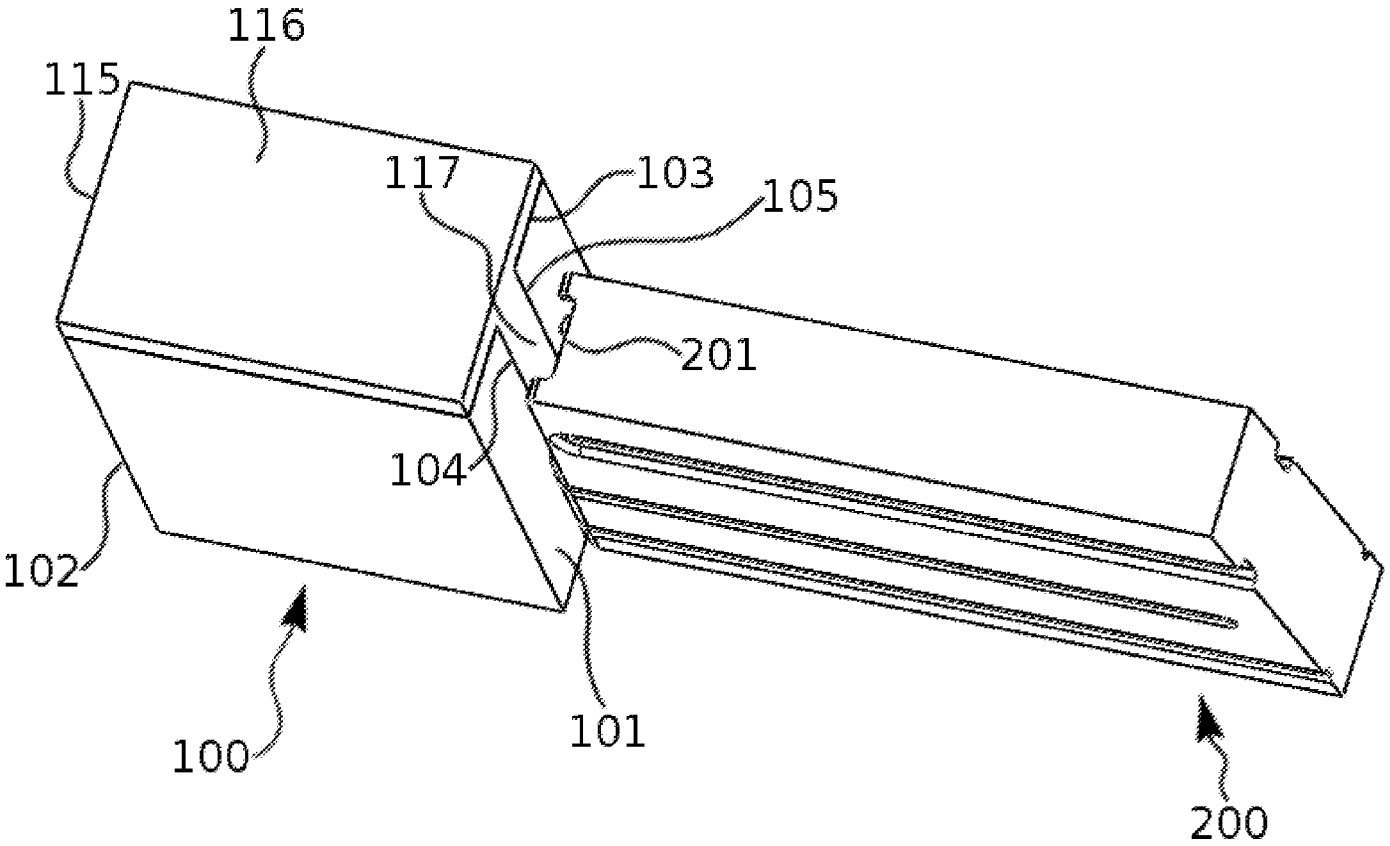
FIG. 4 is an angled side view of the preferred embodiment elongated rectangular box, engaged with the cartridge urging rod, interfaced with a firearms magazine and canted.

In reference to FIG. 4, the apparatus for storing and loading multiple rows of ammunition cartridges is interfaced with a firearms magazine 200 via the engagement of the rectangular box dispensing opening 105 to a feed opening 201 of the firearms magazine 200. A magazine feed opening 201 is engaged to the dispensing opening 105 in such a manner that the magazine 200 is oriented, relative to the dispensing opening 105, to receive cartridges 300 from the rectangular box linear channel 104, through the dispensing opening 105, in the same angular orientation by which the magazine 200 properly feeds ammunition cartridges 300 into a firearm.

Figure 5A:
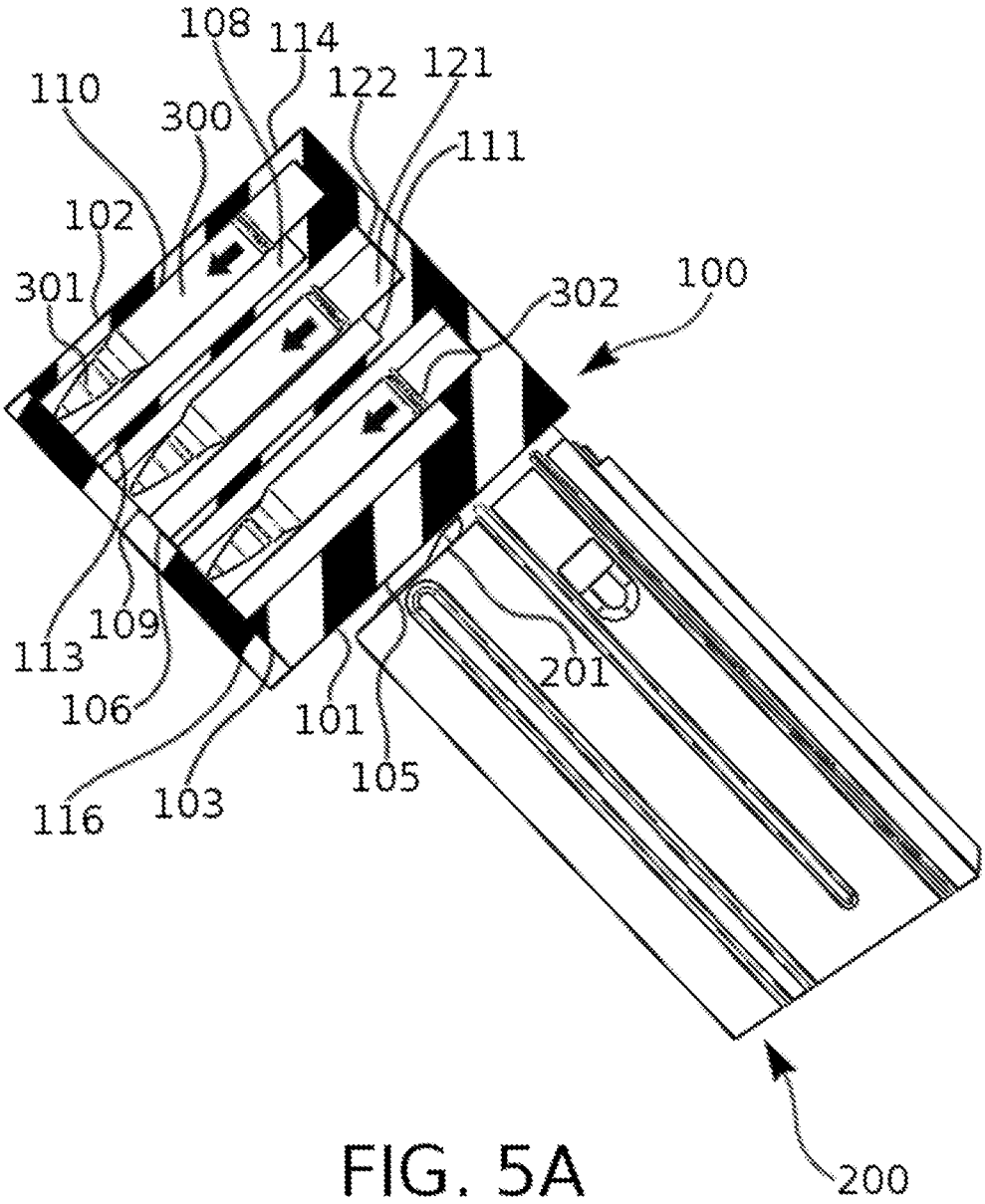
FIG. 5A is a side view cross section of the preferred embodiment elongated rectangular box and coupled magazine canted, with ammunition cartridges displaced from the depressed chambers towards the flat cover.
Figure 5B:
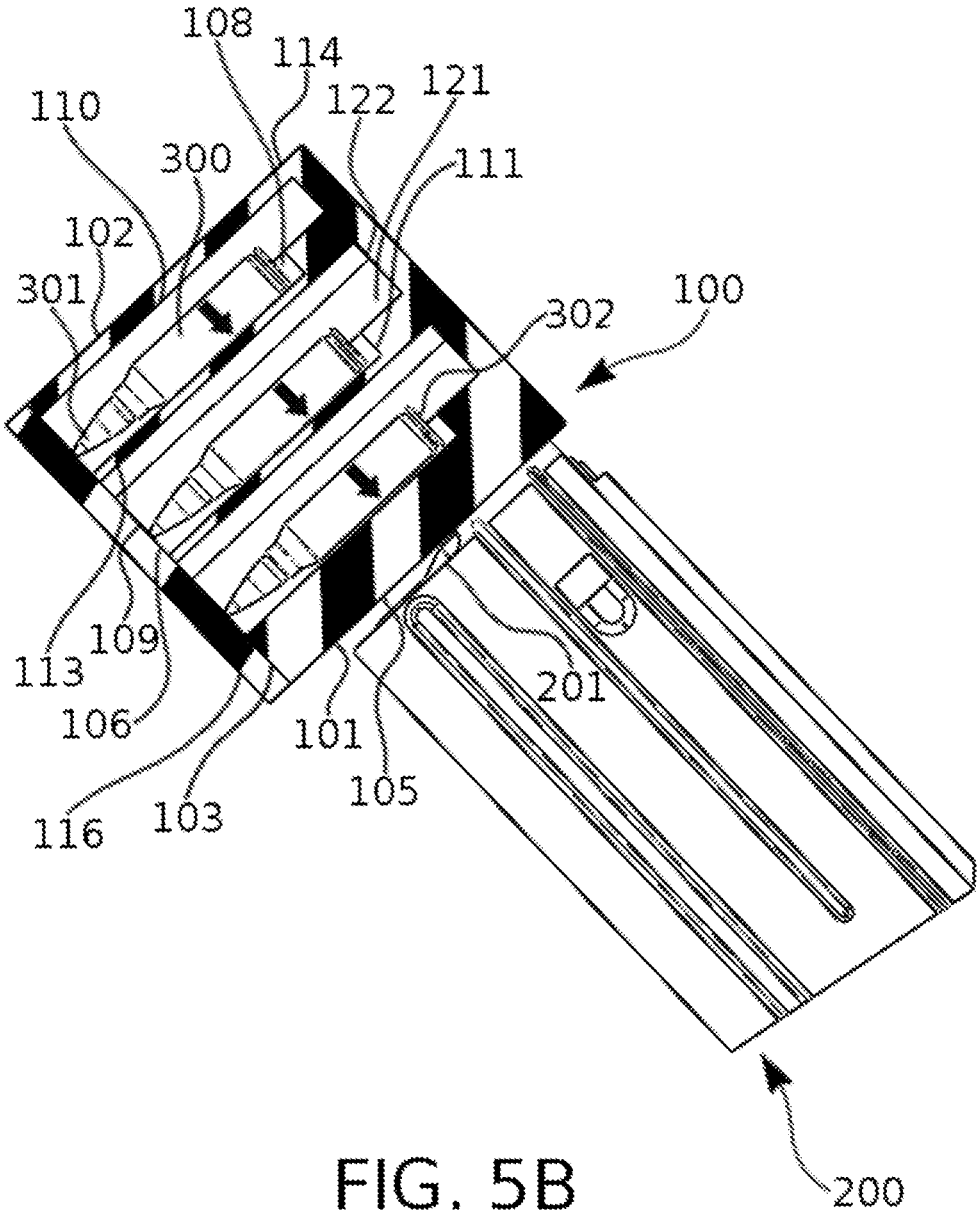
FIG. 5B is a side view cross section of the preferred embodiment elongated rectangular box and coupled magazine canted, with ammunition cartridges tangent with partition walls.
Figure 5C:
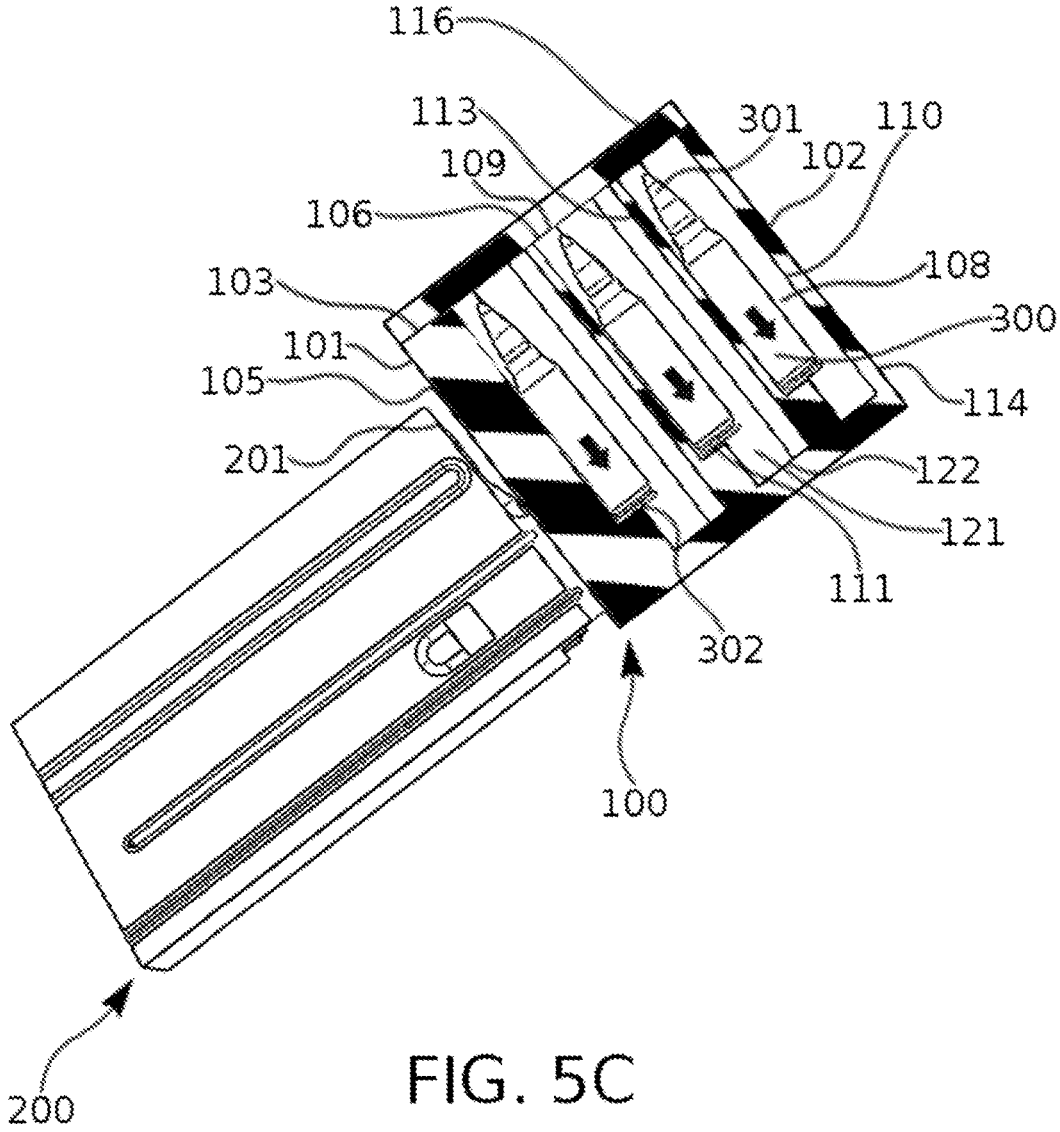
FIG. 5C is a side view cross section of the preferred embodiment elongated rectangular box and coupled magazine canted, with ammunition cartridges tangent with slot floors.

In reference to FIGS. 5A, 5B and 5C, the apparatus for storing and loading multiple rows of ammunition cartridges is configured to displace cartridges 300 from each depressed chamber 121 into a corresponding cartridge slot 108 with the canting of the apparatus and interfaced magazine 200 to such an angular orientation that the linear channel floor 107 is elevated over the adjacent side 103 while the rod entry opening 114 is elevated over the cartridge dispensing opening 105. The angling of this canting causes cartridges 300 hosted in each depressed chamber 121 to move towards the top side openings 109 by force of gravity until obstructed from further directional movement by the flat cover 116. Simultaneous to being obstructed from further directional movement by the flat cover 116, the displaced cartridges 300 fully displace from their respective depressed chambers 121 and move toward partition walls 113 adjacent to their respective depressed chambers 121, by means of gravity, until obstructed from further directional movement by their respectively adjacent partition walls 113. The apparatus and interfaced magazine 200 are then canted to such an angular orientation as to cause the adjacent side 103 to be elevated over the linear channel floor 107 while the rod entry opening 114 is elevated over the cartridge dispensing opening 105. The angling of this canting causes the cartridges 300 obstructed by the flat cover 116 and partition walls 113 to move into tangency with the slot floors 111 by means of gravity. In one embodiment, the base primer sides 302 of cartridges 300 come into tangency with the slot floors 111.

Figure 6A:
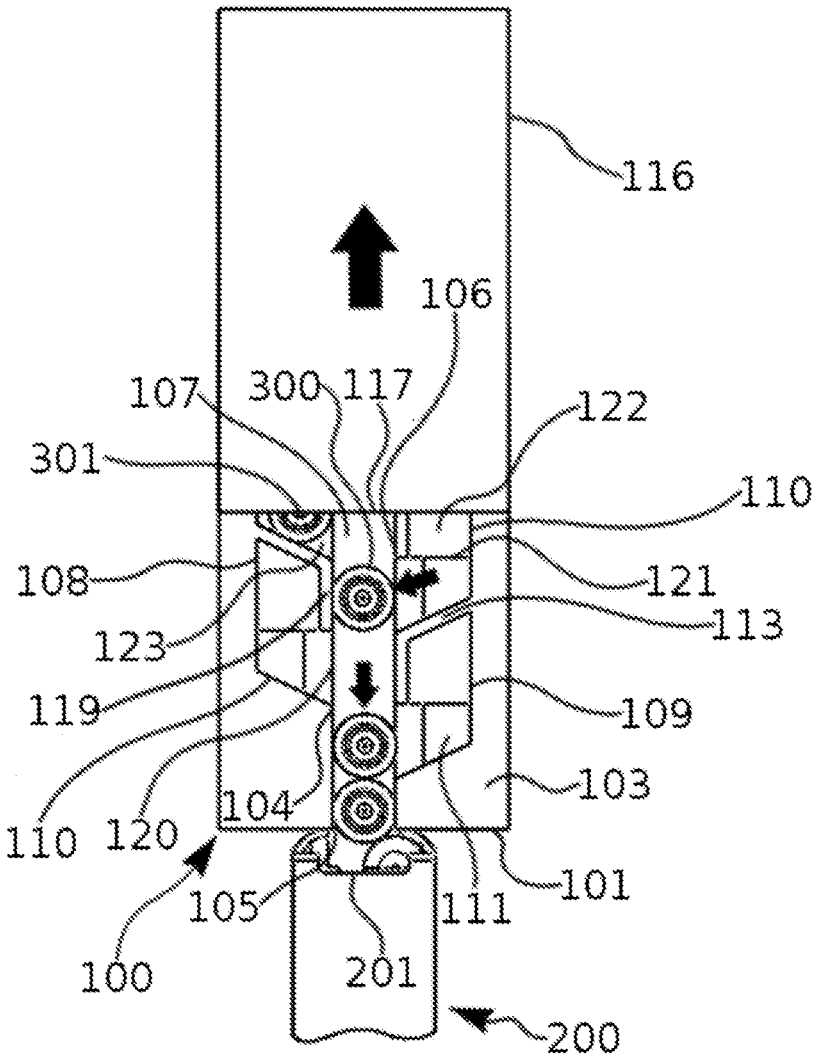
FIG. 6A is a frontal view of the preferred embodiment cartridge urging rod partially retracted from the elongated rectangular box.
Figure 6B:
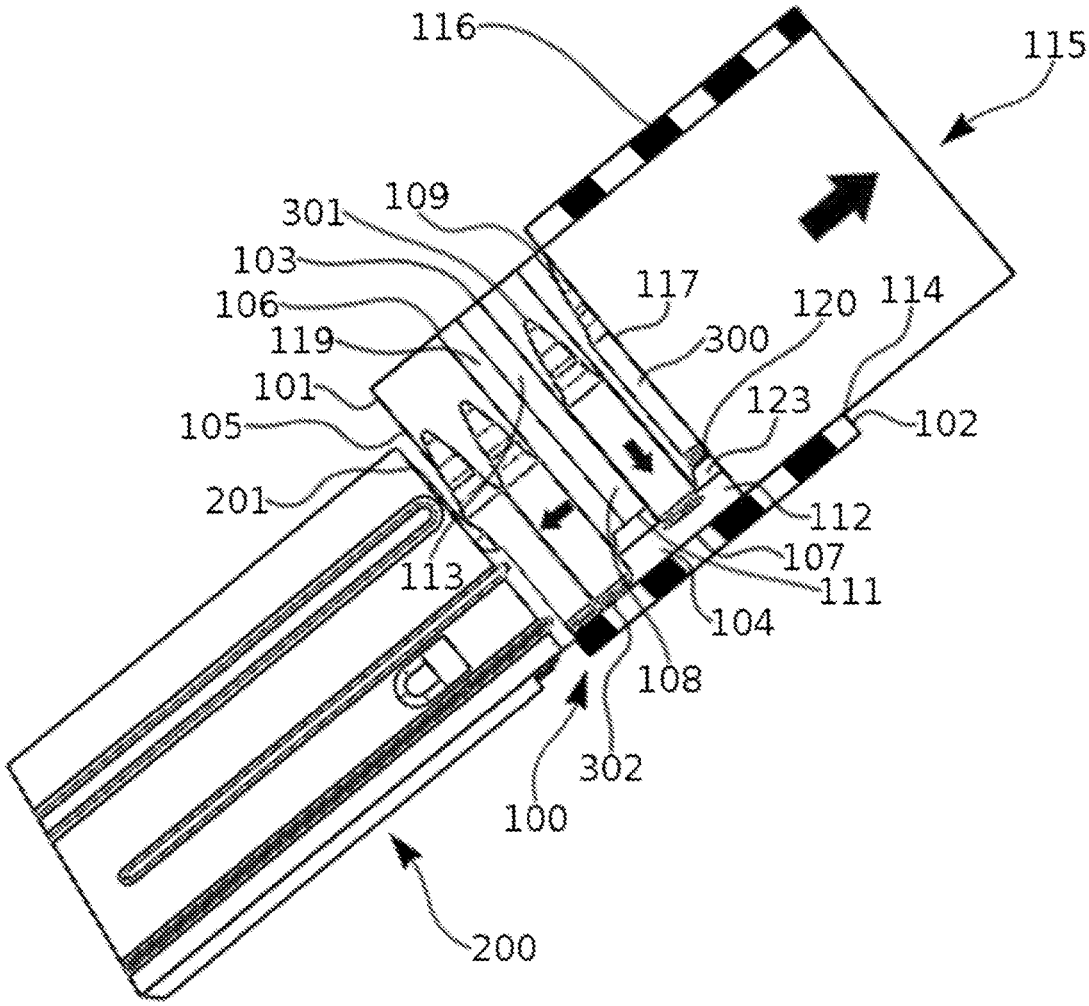
FIG. 6B is a side view cross section of the preferred embodiment cartridge urging rod partially retracted from the elongated rectangular box.

In reference to FIGS. 6A and 6B, the apparatus is configured to dispense cartridges 300 into the interfaced magazine 200 with the retraction of the urging rod 115 from the linear channel 104 through the rod entry opening 114. This action causes the urging rod 115 to be removed from tangency with successive slot side openings 120, clearing a path for cartridges 300 hosted within cartridge slots 108 to shift out from their respective cartridge slots 108, through their corresponding unobstructed slot side openings 120, and move toward the direction of the the linear channel 104. In one embodiment, cartridges 300 are shifted out through their corresponding slot side openings 120 via the assistance of the angled partition walls 113, the slot floor 111 defined slopes 123 and the force of gravity. Each cartridge 300, upon passing through its respective slot side opening 120, moves toward the linear channel 104 until obstructed from further directional movement by an obstruction wall 119 of the opposing row 110. Simultaneous to the point of when each displaced cartridge 300 is obstructed by an obstruction wall 119, the width of each obstructed cartridge 300 lines up with the width of the linear channel 104, allowing each obstructed cartridge 300 to enter the non-convergent height of space 112 within the linear channel 104, by means of gravity. Each cartridge 300 proceeds down the non-convergent height of space 112 until obstructed from further movement by the channel floor 107. Simultaneously, each cartridge 300 also moves towards the dispensing opening 105, by means of gravity, until coming into tangency with the coupled magazine feed opening 201 or a cartridge 300 that is stacked in succession leading into the feed opening 201. In one embodiment, cartridges 300 displaced into the linear channel 104 are filed into a single file row, the length of the single file row running parallel with the length of the linear channel 104, by the non-convergent height of space 112.

Figure 7:
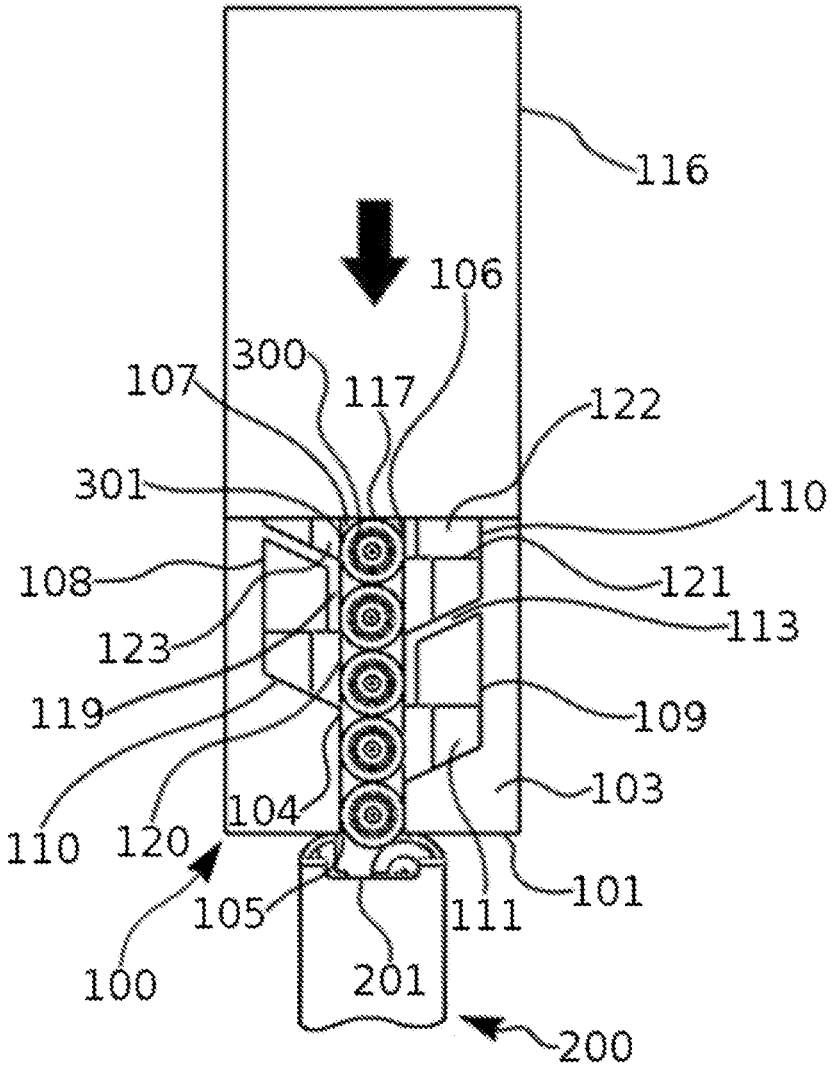
FIG. 7 is a frontal view of the preferred embodiment cartridge urging rod urging cartridges within the linear channel into the interfaced firearms magazine.

In reference to FIG. 7, the apparatus for storing and loading multiple rows of ammunition cartridges urges cartridges 300, displaced into the linear channel 104, into an interfaced firearms magazine 200 with the urging of the pressing surface 117, and thus the urging rod 115, towards the dispensing opening 105. The pressing surface 117, moving towards the dispensing opening 105, comes into tangency with an ammunition cartridge 300 that is of closest proximity to it within the linear channel 104. Upon coming into tangency with a cartridge 300, the urging rod 115 urges said cartridge 300 towards the dispensing opening 105, subsequently causing successive cartridges 300 within the linear channel 104 to urge adjacent cartridges 300 towards the dispensing opening 105. Consequently, the action of urging the rod 115 towards tangency with the dispensing opening 105 causes each cartridge 300 within the linear channel 104 to be displaced from the linear channel 104, through the dispensing opening 105, into the feed opening 201 of the interfaced firearms magazine 200.

The invention claimed is:

1. An apparatus for storing and loading ammunition cartridges into a firearms magazine, comprising:

an elongated rectangular box, comprising a proximal end and a distal end on opposite long ends of the rectangular box;

an adjacent side, located on a side of the rectangular box that lies between the proximal end and the distal end;

a linear channel, running within the rectangular box from the proximal end to the distal end, configured to receive and host ammunition cartridges;

a cartridge dispensing opening, located on the proximal end, open to the linear channel in order to facilitate the passage of ammunition cartridges and objects into and out from the linear channel, and configured to couple with a feed opening of the firearms magazine;

a rod entry opening, located on the distal end, and open to the linear channel in order to facilitate the passage of ammunition cartridges and objects into and out from the linear channel;

a cartridge entry opening, located on the adjacent side, open to the linear channel in order to facilitate the passage of ammunition cartridges and objects into and out from the linear channel;

a linear channel floor, located on a wall of the linear channel opposite the adjacent side;

multiple ammunition cartridge slots, recessed into the rectangular box through the adjacent side, and configured to converge with the linear channel and host ammunition cartridges;

a cartridge urging rod, configured to selectively slideably engage within the linear channel and urge ammunition cartridges and objects hosted within the linear channel out from the linear channel; and a flat cover, coupled to the cartridge urging rod, and sized to cover the adjacent side and obstruct withdrawal of ammunition cartridges from the multiple ammunition cartridge slots when the cartridge urging rod is positioned within the linear channel.

2. The apparatus of claim 1, wherein the multiple ammunition cartridge slots are arranged in multiple independent rows that run parallel with the linear channel.

3. The apparatus of claim 2, wherein the multiple ammunition cartridge slots are arranged in two independent rows, each of which lie adjacent to the linear channel on two opposing sides of the linear channel.

4. The apparatus of claim 2, wherein each ammunition cartridge slot of the multiple ammunition cartridge slots comprises a partition wall that segregates a respective ammunition cartridge slot from an adjacent ammunition cartridge slot.

5. The apparatus of claim 4, wherein the partition walls are sloped in such a manner as to guide ammunition cartridges hosted within the multiple ammunition cartridge slots into the linear channel.

6. The apparatus of claim 4, wherein the partition walls of a first row of ammunition cartridge slots are offset with the partition walls of a second row of ammunition cartridge slots.

7. The apparatus of claim 4, wherein each ammunition cartridge slot of the multiple ammunition cartridge slots comprises an obstruction wall that is configured to obstruct ammunition cartridges, displaced from an adjacent row of ammunition cartridge slots, from entering into the respective ammunition cartridge slot.

8. The apparatus of claim 7, wherein each said obstruction wall is parallel to the linear channel.

9. The apparatus of claim 4, wherein each ammunition cartridge slot comprises a side opening that leads from a respective ammunition cartridge slot into the linear channel.

10. The apparatus of claim 1, wherein the multiple ammunition cartridge slots are recessed into the rectangular box to such a depth as to leave a height of space within the linear channel, spanning from a bottom of each ammunition cartridge slot of the multiple ammunition cartridge slots that is adjacent to the linear channel to the linear channel floor.

11. The apparatus of claim 10, wherein the bottom of each ammunition cartridge slot of the multiple ammunition cartridge slots that is adjacent to the linear channel is sloped relative to the linear channel floor.

12. The apparatus of claim 10, wherein the multiple ammunition cartridge slots each define a depressed chamber that is deeper than an adjacent portion of the respective ammunition cartridge slot.

13. The apparatus of claim 12, wherein each ammunition cartridge slot of the multiple ammunition cartridge slots comprises an obstruction wall that is configured to obstruct ammunition cartridges, displaced from an adjacent row of ammunition cartridge slots, from entering into the respective ammunition cartridge slot, and wherein each depressed chamber is separated from the linear channel by a respective obstruction wall.

14. The apparatus of claim 12, wherein the depressed chambers are configured to host ammunition cartridges.

15. The apparatus of claim 14, wherein openings in the adjacent side leading into each ammunition cartridge slot of the multiple ammunition cartridge slots are configured to facilitate the passage of ammunition cartridges into the multiple ammunition cartridge slots and the depressed chambers.

16. A method for storing ammunition cartridges within an apparatus for storing and loading ammunition, comprising:

(1) providing the apparatus of claim 1;

(2) orienting the apparatus in such a manner as to elevate the cartridge dispensing opening over the rod entry opening;

(3) following (2), positioning ammunition cartridges into the multiple ammunition cartridge slots through openings on the adjacent side leading into the ammunition cartridge slots;

(4) following (3), slideably engaging the cartridge urging rod within the linear channel through the rod entry opening while slideably engaging the flat cover with the adjacent side; and (5) following (4), urging the cartridge urging rod towards the cartridge dispensing opening, thereby obstructing openings leading from the ammunition cartridge slots into the linear channel with the cartridge urging rod and covering with the flat cover openings on the adjacent side leading into the ammunition cartridge slots.

17. A method for loading ammunition cartridges into a firearms magazine using an apparatus for storing and loading ammunition, comprising:

(6) performing the method of claim 16;

wherein the multiple ammunition cartridge slots are recessed into the rectangular box to such a depth as to leave a height of space within the linear channel, spanning from a bottom of each ammunition cartridge slot of the multiple ammunition cartridge slots that is adjacent to the linear channel to the linear channel floor;

wherein the multiple ammunition cartridge slots each define a depressed chamber that is deeper than an adjacent portion of the respective ammunition cartridge slot;

following (6):

(7) coupling a feed opening of an ammunition magazine with the cartridge dispensing opening of the apparatus;

(8) following (7), canting the apparatus in to such an orientation as to cause the rod entry opening to elevate over the cartridge dispensing opening while the linear channel floor elevates over the adjacent side, thereby causing ammunition cartridges hosted within the depressed chambers of the multiple ammunition cartridge slots to shift into engagement with the flat cover;

(9) following (8), canting the apparatus to such an orientation as to cause the adjacent side to elevate over the linear channel floor, thereby causing ammunition cartridges to shift onto the bottoms of the multiple ammunition cartridge slots that are adjacent to the linear channel;

(10) following (9), retracting the cartridge urging rod out from the linear channel through the rod entry opening, thereby unobstructing side openings leading from the cartridge slots into the linear channel and influencing ammunition cartridges to displace from the multiple cartridge slots into the linear channel by means of gravity; and

(11) following (10), urging the cartridge urging rod through the linear channel and toward the cartridge dispensing opening, thereby causing the cartridge urging rod to shift the displaced cartridges from the linear channel into the coupled magazine feed opening.

18. The method of claim 17, wherein each ammunition cartridge slot of the multiple ammunition cartridge slots comprises a partition wall that segregates a respective ammunition cartridge slot from an adjacent ammunition cartridge slot;

wherein the partition walls are sloped in such a manner as to guide ammunition cartridges hosted within ammunition cartridge slots into the linear channel; and wherein ammunition cartridges are influenced from the ammunition cartridge slots into the linear channel by means of the sloped partition walls.

19. The method of claim 17, wherein the multiple ammunition cartridge slots are recessed into the rectangular box to such a depth as to leave a height of space within the linear channel, spanning from a bottom of each ammunition cartridge slot of the multiple ammunition cartridge slots that is adjacent to the linear channel to the linear channel floor;

wherein the bottom of each ammunition cartridge slot of the multiple ammunition cartridge slots that is adjacent to the linear channel is sloped relative to the linear channel floor; and wherein ammunition cartridges are influenced from the ammunition cartridge slots into the linear channel by means of the bottoms of the multiple ammunition cartridge slots being sloped.

20. The method of claim 17, wherein ammunition cartridges displaced into the linear channel are obstructed from moving into adjacent ammunition cartridge slots and depressed chambers by obstruction walls.

21. An apparatus for storing and loading ammunition cartridges, the apparatus comprising:

an elongated box having a proximal end, a distal end opposite the proximal end, an adjacent side extending between the proximal end and the distal end, wherein the proximal end is configured to be coupled with a feed opening of a firearms magazine, wherein the elongated box defines a linear channel running longitudinally from the proximal end to the distal end, wherein the linear channel has a linear channel floor opposite the adjacent side, wherein the elongated box defines multiple ammunition cartridge slots configured to receive ammunition cartridges via the adjacent side, wherein the multiple ammunition cartridge slots are spaced longitudinally along at least one lateral side of the linear channel, wherein each ammunition cartridge slot of the multiple ammunition cartridge slots is configured to receive one or more ammunition cartridges and has a respective slot floor that is offset from the linear channel floor, wherein the elongated box includes partition walls that separate adjacent ammunition cartridge slots of the multiple ammunition cartridge slots, wherein the elongated box includes obstruction walls that separate first portions of the multiple ammunition cartridge slots from the linear channel, wherein the first portions of the multiple ammunition cartridge slots define depressed chambers that extend deeper than adjacent portions of the multiple ammunition cartridge slots relative to the adjacent side; and a cartridge urging rod configured to be inserted into and slide along the linear channel from the distal end to the proximal end, wherein the cartridge urging rod is configured to urge ammunition cartridges that have been displaced from the multiple ammunition cartridge slots into the linear channel from the linear channel out of the elongated box via the proximal end.

22. The apparatus of claim 21, wherein the respective slot floor within each adjacent portion of the multiple ammunition cartridge slots is sloped relative to the linear channel floor.

23. The apparatus of claim 21, wherein the multiple ammunition cartridge slots comprise a first row of slots on a first lateral side of the linear channel and a second row of slots on a second lateral side of the linear channel opposite the first lateral side.

24. The apparatus of claim 21, further comprising:

a cover coupled to the cartridge urging rod and configured to slide along the adjacent side and cover the multiple ammunition cartridge slots when the cartridge urging rod is inserted into and slid along the linear channel from the distal end to the proximal end.

* * * * *